US005840460A

United States Patent [19]

Machida et al.

[11] Patent Number: 5,840,460

[45] Date of Patent: Nov. 24, 1998

[54] TONER FOR DEVELOPING ELECTROSTATIC LATENT IMAGES

[75] Inventors: Junji Machida, Toyonaka; Chikara Tsutsui, Nishinomiya, both of Japan

[73] Assignee: Minolta Co., Ltd, Osaka, Japan

[21] Appl. No.: 792,125

[22] Filed: Jan. 31, 1997

[30] Foreign Application Priority Data

Feb. 2, 1996 [JP] Japan ..... 8-017504
Feb. 21, 1996 [JP] Japan ..... 8-033564

[51] Int. Cl.[6] ..... G03G 9/087; G03G 9/097

[52] U.S. Cl. ..... 430/110; 430/111; 430/903

[58] Field of Search ..... 430/110, 111, 430/903

[56] References Cited

U.S. PATENT DOCUMENTS

| | | | |
|---|---|---|---|
| 4,626,488 | 12/1986 | Inoue | 430/109 |
| 4,810,612 | 3/1989 | Ueda et al. | 430/109 |
| 4,873,185 | 10/1989 | Uchida et al. | 430/110 |
| 4,917,982 | 4/1990 | Tomono et al. | 430/99 |
| 4,954,411 | 9/1990 | Nishibayashi et al. | 430/111 |
| 5,079,123 | 1/1992 | Nanya et al. | 430/106.6 |
| 5,124,225 | 6/1992 | Shibata | 430/110 |
| 5,176,978 | 1/1993 | Kumashiro et al. | 430/110 |
| 5,238,767 | 8/1993 | Horiie | 430/110 |

FOREIGN PATENT DOCUMENTS

| | | |
|---|---|---|
| 55-90509 | 7/1980 | Japan . |
| 62-203182 | 9/1987 | Japan . |
| 3-7972 | 1/1991 | Japan . |
| 4-50863 | 2/1992 | Japan . |
| 6-130725 | 5/1994 | Japan . |

*Primary Examiner*—Roland Martin
*Attorney, Agent, or Firm*—McDermott, Will & Emery

[57] ABSTRACT

A toner for developing electrostatic images is provided which has good adhesion resistance and good low temperature fixing property, and further can exhibit good image developing performance in various quality aspects including fog resistance, filming resistance, and image density. The toner includes at least a binder resin and a colorant and is characterized in that the toner, prepared as such, has a melt index range of 15 to 40 (g/10 minutes) at 125° C. and the binder resin has a melt index range of 3 to 12 (g/10 minutes) at 150° C.

20 Claims, 2 Drawing Sheets

TONER FOR DEVELOPING ELECTROSTATIC LATENT IMAGES

BACKGROUND OF THE INVENTION

1. Field of the Invention

The present invention relates to an electrostatic image developing toner for use in electrophotography, electrostatic recording and electrostatic printing.

2. Description of the Prior Art

For developing electrostatic images two systems are known, namely, a two-component development system which uses a mixture of a magnetic carrier and a nonmagnetic toner, and a mono-component development system in which no carrier is used. Hitherto, the two-component development system, as main stream of the art, has been more widely used. Recently, however, the mono-component system has been gaining popularity since the system does not use carrier and, therefore, has such features that it involves no carrier replacement and that it enables stable images to be developed by using a compact and simple developing apparatus.

The mono-component development system is a system such that an electrostatic latent image formed on a photosensitive member is developed by a thin layer of charged toner which is formed on a developing sleeve after its passage through a contact nip between the sleeve and a regulator blade. Toner charging and formation of a thin toner layer on the developing sleeve are carried out at a pressure contact portion of the toner regulator blade, with the result that stress is applied on the toner so that toner adhesion to the toner regulator blade and/or developing sleeve is likely to occur.

It is generally known that a toner having good fixing property which is not liable to such defective occurrences as fogging, filming and toner adhesion is useful for the purpose of obtaining good quality image. Recently, from the view points of size reduction and energy saving with respect to image forming apparatus, there has been a need for low temperature fixation in particular. If this need can be met, not only is it possible to achieve energy saving in the use of image forming apparatus, but also it is possible to provide greater ease of operation through a decrease in the time for warming up.

Along with size reduction in image forming apparatus, it is necessary that fixing rollers be made smaller in size; and the reduction in the size of fixing rollers means that the nip between the pair of fixing rollers is made narrower accordingly. Hence, there arises a need for a toner with better fixing characteristics. This need is more important especially when low temperature fixation is realized.

In order to improve various characteristics required of toner, various proposals have hitherto been made for adjustment of melt index values (hereinafter referred to as "MI value") of toner and/or binder resin for toner. For example, Japanese Patent Application Laid-Open No. Hei 4-50863 discloses that a toner suited for use in the contact charging system must have a moderate particle size and a moderate MI value. However, this toner involves a problem in its low temperature fixing performance.

Japanese Patent Publication No. Sho 63-32181 and Japanese Patent Application Laid-Open No. Hei 6-130725 disclose toners in which MI values of the toner and the binder resin are specified. However, these toners also involve a problem in their fixing performance at low temperature.

On the other hand, a photosensitive member is generally equipped with a cleaning apparatus in order to remove residual toner on the photosensitive drum and to prevent lowering of image-quality. However, such a cleaning apparatus causes wear of the photosensitive drum by friction between the drum and a cleaning blade and disposal of residual toner accumulated in the cleaning apparatus is needed.

In order to solve the above problems, Japanese Patent Laid-Open Nos. Sho 62-203182 and Hei 3-7972 propose a developing apparatus in which development and cleaning are made at the same time and so a conventional cleaning apparatus is not needed. However, even if the conventional toner is applied to the above developing apparatus in order to achieve adhesion resistance and low temperature fixing properties as well as cleaning properties for the photosensitive member in which cleaning and development are made at the same time, many fine particles generate in the process for charging toner by toner-regulating blade and in the developing process of the toner. That involves deterioration of transferring properties of toner from photosensitive drum to transferring paper so that many toner particles remain on the drum. Therefore, such a cleaning system is not satisfactory.

SUMMARY OF THE INVENTION

It is an object of the present invention to provide a toner for developing electrostatic images which has good adhesion resistance and good low temperature fixing property, and further can exhibit good image developing performance in various quality aspects including fog resistance, filming resistance, and image density.

It is another object of the present invention to provide a one-component toner for developing electrostatic latent images which has good adhesion resistance, good low temperature fixing property and cleaning properties of electrostatic latent image-keeping member.

In accordance with the present invention there is provided a toner for developing electrostatic images which includes at least a binder resin and a colorant, wherein the toner, prepared as such, has a melt index (hereinafter referred to as "MI value") range of 15 to 40 (g/10 minutes) at 125° C. and the binder resin has MI value of 3 to 12 (g/10 minutes) at 150° C.

There is also provided a one-component toner fixed by heat, having MI value of 10 to 40 (g/10 minutes), grindability index of 1.0 to 3.0, volume mean particle size of 5.0 to 9.0 $\mu$m.

BRIEF DESCRIPTION OF THE INVENTION

DETAILED DESCRIPTION OF THE INVENTION

Figure 1:
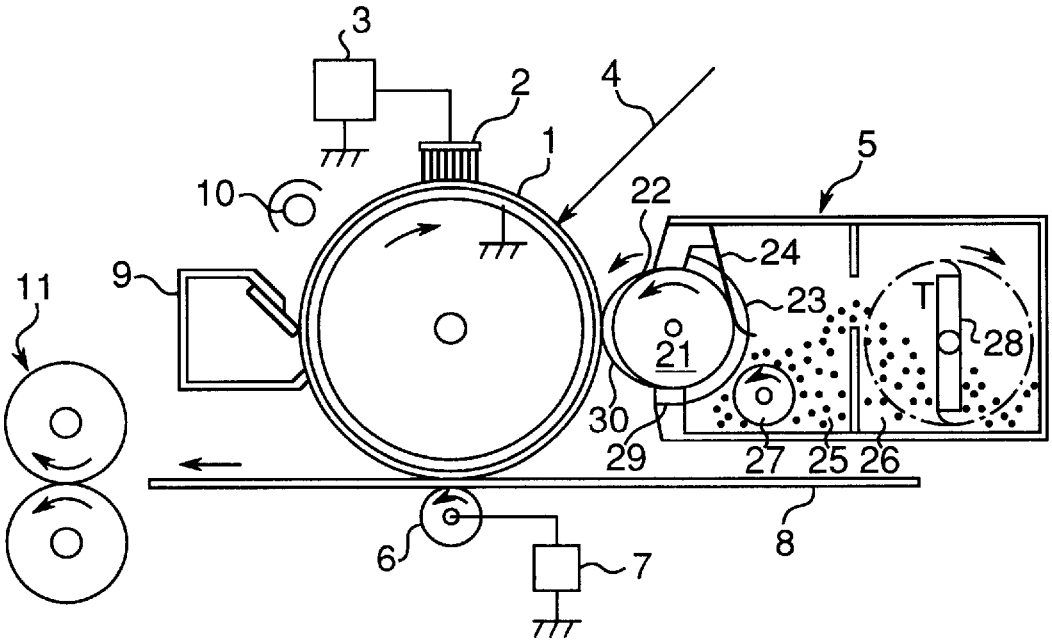
FIG. 1 is a schematic diagram of one-component developing apparatus.

The electrostatic image-developing toner of the invention is characterized in that the MI value of the toner and that of the binder resin contained in the toner are specified. By arranging that a prepared toner has a desired MI value it is possible to provide good fixing characteristic at low temperatures. Further, by specifying the MI value for the binder resin contained in the toner to enable the binder resin to have moderate hardness, it is possible to avoid excessive milling in the process of toner production thereby to inhibit fine powder generation, thus preventing toner adhesion due to the presence of fine powder, fogging, filming, etc., and any resulting degradation in image quality.

The MI value (g/10 min.) range at 125° C. of the toner of the invention is 10 to 40, preferably 15 to 40, more preferably 15 to 35 and the MI value (g/10 min.) range of the binder resin at 150° C. is 3 to 12. MI value is an index indicative of melt viscosity at a specific temperature. The larger the MI value, the lower is the viscosity at the specific temperature. If the MI value of the toner is lower than 15, the toner involves a problem in its low temperature fixing performance. If the value is higher than 40, the toner is excessively low in viscosity and involves an offset problem. If the MI value of the binder resin is lower than 3, the resin is excessively hard and has poor grindability, thus involving a problem in respect of productivity such that excessive grinding may occur in the course of grinding operation, resulting in fine powder generation. If the MI value is higher than 12, the resin is brittle and is likely to cause fine powder generation within a developing unit, which may result in toner aggregation, toner adhesion, and image quality deterioration and decreased endurance.

The MI value can be adjusted by selecting toner components contained in toner, such as binder resin and off-set preventing agent.

The MI values given above are those measured in accordance with JIS (Japanese Industrial Standards) K-7210, Method A. It is noted, however, that since the toner of the invention, and the binder resin contained in the toner differ widely from each other in melt viscosity characteristics, it was impossible to measure their respective MI values at the same temperature. That is, whereas the toner of the invention, at 125° C., presents a viscosity which is measurable in accordance with the above mentioned measuring method, the binder resin does not become softened at that temperature, and this made it impossible to measure MI value of the resin at 125° C. Whilst, at 150° C., the binder resin presents a measurable viscosity, but the toner of the invention is so low in viscosity that the toner completely drops down, it being thus impossible to measure the MI value of the toner.

In general, a toner for developing electrostatic images comprises at least a binder resin and a colorant and may contain other desired additives, such as anti-offset agent, charge-controlling agent, fluidizing agent, and various kinds of resin-particles.

Binder resins for toner in the present invention are not particularly limited as long as they are resins having an MI value (g/10 min.) range of 3 to 12 at 150° C., such as styrene resins, styrene-acrylic resins, polyester resins, other conventional resins for toner, preferably polyester resins or urethane modified polyester resins. In particular, polyester resins are preferable in non-magnetic one-component developing system, because there rises such a problem as adhesion of toner to a toner levelling blade and a developing sleeve as toner is charged electrically by passing through the pressurized space between the blade and the sleeve.

A polyester resin is synthesized from a polyol component and polycarboxylic acid component. The polyol component comprises at least etherified diphenyl. For the etherified diphenyl may be used an adduct of bisphenol A or diphenyl, such as di-(4-hydroxyphenyl) methane, with a compound selected from the group consisting of ethylene oxide, propylene oxide, diethylene glycol, triethylene glycol, polyethylene glycol, dipropylene glycol, polypropylene glycol, polytetramethylene ether glycol, glycerin, trimethylolpropane, pentaerythritol, dipentaerythritol, and tripentaerythritol. As a dicarboxylic acid component may be used any of the following: maleic acid, fumaric acid, mesaconic acid, citraconic acid, itaconic acid, glutaconic acid, phthalic acid, isophthalic acid, terephthalic acid, succinic acid, adipic acid, sebacic acid, and malonic acid. As a tricarboxylic acid component may be used any of the following; 1, 2, 4-benzene tricarboxylic acid, 1, 2, 5-benzene tricarboxylic acid, 1, 2, 4-cyclohexane tricarboxylic acid, 1, 2, 5-cyclohexane tricarboxylic acid, 1, 2, 4-butane tricarboxylic acid, and 1, 3-dicarboxy-2-methylcarboxypropane tetra(methylcarboxy) methane.

In the synthesis of polyester, polyol components and polycarboxylic acid components may be used in mixtures of plural kinds respectively. It is also possible to incorporate plural kinds of polyester into the toner.

For the binder resin it is also possible to use a urethane modified polyester resin which is produced by subjecting a linear, low molecular-weight polyester resin to a chain extension reaction in the presence of isocyanate. For the isocyanate component may be used hexamethylene isocyanate, isophorone diisocyanate, tolylene diisocyanate. diphenylmethane-4, 4'-diisocyanate, and xylylene diisocyanate. Such diisocyanate is added in such a way that the molar ratio (NCO/OH) of isocyanate group (—NCO group) to hydroxyl group (—OH group) present in the polyester will be 0.8 to 1.5, preferably 1.0 to 1.3.

Polyester resins suitable for use in the invention have physical properties as described below. The softening point of such polyester resin is within the range of 90° C. to 140° C., preferably 90° C. to 135° C., more preferably 95° C. to 130° C. If the softening point (Tm) is less than 90° C., there may arise a problem in respect of heat resistance during storage. If it is more than 140° C., there may arise a problem in respect of low temperature fixation. The glass transition point (Tg) of the polyester is within the range of 55° C. to 75° C., preferably 60° C. to 70° C., more preferably 57° C. to 68° C. If the glass transition point is less than 55° C., there may occur the trouble of toner agglomeration; and if it is more than 75° C., there may arise a problem in respect of low temperature fixation. The acid value (Av) of the polyester resin is within the range of 5 to 50 KOHmg/g, preferably 10 to 40 KOHmg/g. If the acid value is less than 5 KOHmg/g, the colorant, anti-offset agent, or the like contained in the toner will be adversely affected in respect of dispersibility, so that unsatisfactory toner charging may occur, resulting in fogging. If the acid value is more than 50 KOHmg/g, there may arise an environmental problem, such as humidity resistance. The content of components insoluble in methyl ethyl ketone is within the range between 5 and 30 percent by weight. If the content is less than 5 percent by weight, non off-set range becomes narrow. If the content is larger than 30 percent by weight, low temperature fixation is deteriorated.

An anti-offset agent useful for the purpose of the invention has a softening point within the range of 60° to 150° C. Examples of such anti-offset agent include low molecular-weight polyolefin waxes, such as polyethylene wax and polypropylene wax; oxidized-type low molecular-weight polyolefin waxes, such as oxidized-type polyethylene wax and oxidized-type polypropylene wax; carnauba wax, sazol wax; rice wax; candelilla wax; jojoba oil wax; and beeswax. The proportion of such agent relative to 100 parts by weight of the toner resin is within the range of 2 to 7 parts by weight, preferably 3 to 5 parts by weight.

Preferably, an anti-offset agent having an acid value within the range of 1 to 45 KOH mg/g, preferably 2 to 30 KOH mg/g, is used so that dispersibility relative to the binder resin can be improved. It is especially preferable to use two kinds of anti-offset agents in order to achieve two purposes of low temperature offset prevention and high temperature offset prevention.

Anti-offset agents useful for the purpose of preventing low-temperature offset have a softening point lower than that of the binder resin, preferably at least 10° C. lower. More specifically, useful anti-offset agents or waxes have a softening point within the range of 60° to 100° C., preferably 70° to 90° C., and have an acid value within the range of 1 to 20 KOH mg/g, preferably 3 to 15 KOH mg/g. Examples of such anti-offset agent include carnauba wax, sazol wax, RICE wax, candelilla wax, jojoba oil wax, beeswax. and oxidized-type polyethylene wax. The proportion of such agent relative to 100 parts by weight of the toner resin is within the range of 1 to 6 parts by weight, preferably 2 to 5 parts by weight.

Anti-offset agents useful for the purpose of preventing high-temperature offset have a softening point substantially equal to that of the binder resin, preferably at least 10° C. higher. More specifically, useful anti-offset agents or waxes have a softening point within the range of 110° to 150° C., preferably 120° to 150° C., and have an acid value within the range of 1 to 30 KOH mg/g, preferably 2 to 20 KOH mg/g. One example of such anti-offset agent is oxidized-type low molecular weight polyolefin wax. The proportion of such agent relative to 100 parts by weight of the toner resin is within the range of 0.5 to 5 parts by weight, preferably 1 to 3 parts by weight.

In the case where such two kinds of anti-offset agents are incorporated into the toner, the total amount of the agents is within the range of 2 to 7 parts by weight, preferably 3 to 5 parts by weight, and from the standpoints of low temperature fixation and offset inhibition it is desirable that the proportion of the low temperature offset inhibiting agent be set larger than that of the high temperature offset inhibiting agent. If the total amount of the agents is less than 2 parts by weight, the resulting effect is insufficient for offset prevention. If the total amount is more than 7 parts by weight, the fluidity of the toner may be rendered unfavorable. Of the above enumerated anti-offset agents, carnauba wax and oxidized-type low molecular-weight polyolefin wax are most preferred for use in combination.

In the present invention, "softening point" indicates a value measured by a differential scanning calorimeter (DSC).

Colorants useful for the purpose of the present invention are not particularly limited, but any of those colorants which have conventionally been used in the art of electrophotography may be equally used in the invention. Examples of such colorants are exemplified below.

Black pigments useful as such in the present invention include, for example, carbon black, copper oxide, manganese dioxide, aniline black, activated carbon, graphite, ferrite, and magnetite.

Useful yellow pigments include, for example, chrome yellow, zinc yellow, cadmium yellow, yellow iron oxide, mineral fast yellow, nickel titanium yellow, Naples yellow, naphthol yellow S, Hansa Yellow G, Hansa Yellow 10G, benzidine yellow G, benzidine yellow GR, quinoline yellow lake, permanent yellow NCG, and Tartrazine lake.

Useful red pigments include, for example, chrome orange, molybdenum orange, permanent orange GTR, pyrazalone orange, vulcan orange, indanthrene brilliant orange RK, benzidine orange G, indanthrene brilliant orange GK, red oxide, cadmium red, red lead oxide, permanent red 4R, lithol red, pyrazolone red, Watchung red, lake red C, lake red D, brilliant carmine 6B, eosine lake, rhodamine lake B, alizarin lake, brilliant carmine 3B, permanent orange GTR, vulcan fast orange GG, permanent red F4RH, and permanent carmine FB.

Useful blue pigments include, for example, iron blue, cobalt blue, alkali blue lake, victoria blue lake, and phthalocyanine blue.

The proportion of these colorants may be within the range of 1 to 20 parts by weight, preferably 3 to 15 parts by weight, relative to 100 parts by weight of resin in the toner.

Charge controlling agents which have hitherto been generally used in dry-type developing agents may be used as required. Metal-loaded or metal-free complex salts may be added as negative charge-controlling agents. For example, chromium complex salt type azo dyes, copper phthalocyanine pigments, chromic complex salt, aluminum complex salt, calix arene compounds, and quaternary fluoroammonium salts may be used as such. The proportion of such negative-charge controlling agents is within the range of 0.5 to 8 parts by weight, preferably 1 to 5 parts by weight, relative to 100 parts by weight of the resin used in the toner.

The toner of the invention may be added with a fluidizing agent as required. In the case where a fluidizing agent is used, fine particles of the following materials may be use: silica, titanium dioxide, alumina, magnesium fluoride, silicon carbide, boron carbide, titanium carbide, zirconium carbide, magnetite, molybdenum disulfide, aluminum stearate, magnesium stearate, and zinc stearate. Preferably, fine particles of those materials are used after having been hydrophobically treated with silane coupling agent, titanium coupling agent, higher fatty acid, silicone oil, or the like. Such fluidizing agent is used preferably in the amount of from 0.05 to 5 parts by weight, more preferably from 0.1 to 3 parts by weight, relative to 100 parts by weight of the toner.

Further, various kinds of particulate resin materials produced by emulsion polymerization, soap-free emulsion polymerization, non-aqueous dispersion polymerization, and the like may be added alone or in combination.

The toner for electrostatic image development in accordance with the present invention is easily obtainable by various known methods including, for example, one method wherein such materials as mentioned above are mixed and kneaded, and the mixture, after being cooled, is pulverized, then classified; suspension polymerization; emulsion polymerization; and spray drying. The resulting toner particles have a volume-mean particle size from 4 to 15 $\mu$m, preferably from 5 to 12 $\mu$m, more preferably from 5 to 9 $\mu$m, most desirably from 6 to 8 $\mu$m. If the particle size is less than 4 $\mu$m, some inconvenience may be caused in respect of handling during development, transferring and fixing operation, resulting in image quality degradation, lower productivity and high cost. If the particle size is more than 15 $\mu$m, the desired improvement in image quality cannot be achieved.

The toner of the present invention is prepared so that the toner can have the MI value of 10 to 40 at 125° C., preferably 15 to 40, more preferably 15 to 35.

The resultant toner may be specified by the grindability index. When specified by the grindability index, the index may be adjusted to 1.0 to 3.0, preferably 1.5 to 3.0. As the value of the grindability becomes larger, the toner particles become harder. This index can be adjusted by selecting a binder resin, particularly, molecular weight of the resin, content of component insoluble in a solvent. If the grindability index is less than 1.0, toner particles become so soft and fragile that toner particles are liable to be broken to generate fine particles when stirred or charged electrically in a developing apparatus, resulting in formation of fogging and unsatisfactory cleaning properties. In addition, toner particles deform by having contact with toner-levelling member etc., causing adhesion of toner to blade or sleeve. On the other hand, if the grindability index is larger than 3.0, toner particles become too hard to be fixed well. The productivity of toner becomes worse because the toner particles are hard to be broken. When the toner is specified by the grindability index, it is not necessarily required to use the binder resin having MI value of 3 to 12 (g/minutes) at 150° C. When the resultant toner has such MI value or grindability index as above mentioned, the objects and effects of the present invention can be achieved. It is, however, preferable to use the resin having the softening point (Tm) of 90° to 140° C. from the viewpoint of low-temperature fixation.

The toner of the invention, thus obtained, is applied for use in, for example, a non-magnetic mono-component developing apparatus shown schematically in FIG. 1. This apparatus is of such arrangement that a regulating blade is pressed against the surface of a toner transporting member (developing sleeve) for regulating the quantity of toner present on the surface of the toner keeping member, and concurrently for triboelectrically charging the toner supplied onto the surface of the toner keeping member so that the triboelectrically charged toner is supplied from the toner keeping member to a photosensitive member.

In FIG. 1, a photosensitive drum 1 has a photosensitive layer formed on a photoconductive substrate and is driven to rotate in the direction indicated by an arrow. A charging brush 2, as a charging member, is disposed in contact with the surface of the photosensitive drum 1. A predetermined charging voltage is applied by a power supply 3 to the charging brush 2 so that the surface of the photosensitive drum 1 is charged to a predetermined polarity and surface potential. An electrostatic latent image is formed by image exposure 4 on the surface of the photosensitive drum 1 which has been charged to the predetermined potential, and the electrostatic latent image is developed by a non-magnetic mono-component developing apparatus 5 to form a toner image. The mono-component developing apparatus 5 will be described in detail hereinafter.

A transfer roller 6, as a transfer member, has an electroconductive elastic layer formed on the outer periphery of a core and is held in contact with the photosensitive drum 1 under a predetermined pressure, being thus caused to rotate in the direction shown by an arrow. A bias voltage of polarity opposite to the polarity of charged toner is applied by a power supply 7 to the transfer roller 6. A transfer medium 8 is transported between the photosensitive drum 1 and the transfer roller 6 so that the toner image on the photosensitive drum 1 is transferred onto the transfer medium 8 under the bias voltage applied as described above.

The transfer medium 8 with the toner image transferred on its surface is transported to a fixing unit which includes a fixing roller pair 11 (with a spring pressure of, for example, 4.5 kg) consisting of a heating roller (for example, 20 mm in diameter) having an internally disposed heater therein and a pressure roller (for example, 20 mm in diameter) held in pressure contact with the heating roller, such that the toner image carried on the surface of the transfer medium is fixed as the transfer medium passes through a nip between the fixing roller pair 11.

After the toner image is transferred onto the transfer medium 8, the surface of the photosensitive drum 1 is cleaned by a cleaning device 9 equipped with a cleaning blade, so that foreign matters, such as residual toner and paper powder, are removed from the surface. Then, the drum surface is destaticized through light projection from a destaticizer 10 and is then employed for a next cycle of image forming operation.

The developing apparatus 5 of the mono-component type in which the toner of the present invention is to be employed includes a driving roller 21 driven by a driving means (not shown) to rotate in the direction shown by an arrow, and a flexible developing-sleeve 22 having an inner diameter slightly larger than the outer diameter of the driving roller, the sleeve 22 being fitted over the roller 21. The developing sleeve 22 is held in pressure contact at opposite ends thereof with the driving roller 21 by being pressed by a pressing guide 23 from behind, while a slack portion 30 on an opposite side, formed due to the pressure contact, is in soft contact with the photosensitive drum 1. A toner regulating blade 24 abuts against the developing sleeve 22 from the same side as the pressing guide 23.

A buffer chamber 25 is located behind the developing sleeve 22, and a toner supply chamber 26 is located behind the buffer chamber 25. A toner feeding rotary member 27 is disposed in the buffer chamber 25, and a toner agitating and feeding rotary member 28 is disposed in the toner supply chamber 26. A lower seal member 29 for preventing any outward leakage of toner from the buffer chamber 25 is held in contact with the underside of the developing sleeve 22. According to such arrangement of the developing apparatus, masses of nonmagnetic mono-component toner, as delivered from the toner supply chamber 26 into the buffer chamber 25 through rotation of the rotary member 28, are sequentially supplied onto the developing sleeve 22 through rotation of the toner feeding rotary member 27.

Meanwhile, the developing sleeve 22 is driven to rotate in association with the driving rotation of the drive roller 21 under a frictional force, so that toner supplied to the developing sleeve 27 is triboelectrically charged under the pressure from the toner regulating blade 24 and regulated to a thin toner layer of a predetermined thickness as it passes between the blade 24 and the sleeve 22. The thin layer of toner so formed is retained on the surface of the developing sleeve 22 and is transported to a developing zone facing the photoconductive drum 1 for development of an electrostatic latent image under a proper development bias applied.

One example of developing apparatus of the nonmagnetic mono-component type in which the toner of the invention can be effectively used has been described. It is understood, however, that the use of the toner of the invention is in no way limited by the example. For example, while in the FIG. 1 developing apparatus the developing sleeve 22 is such that its inner diameter is larger than the outer diameter of the driving roller 21 so as to allow a slack portion 30 to be formed, it is possible to use a developing sleeve which does not allow such a slack portion to be formed, or more specifically a developing sleeve having an inner diameter of the same size as the outer diameter of the drive roller 21.

The configuration of an image forming apparatus with which the toner of the present invention can be employed is not limited to the one shown in FIG. 1. For example, an image forming apparatus of the type schematically illustrated in FIG. 2 is equally applicable for use of the toner of the invention.

Figure 2:
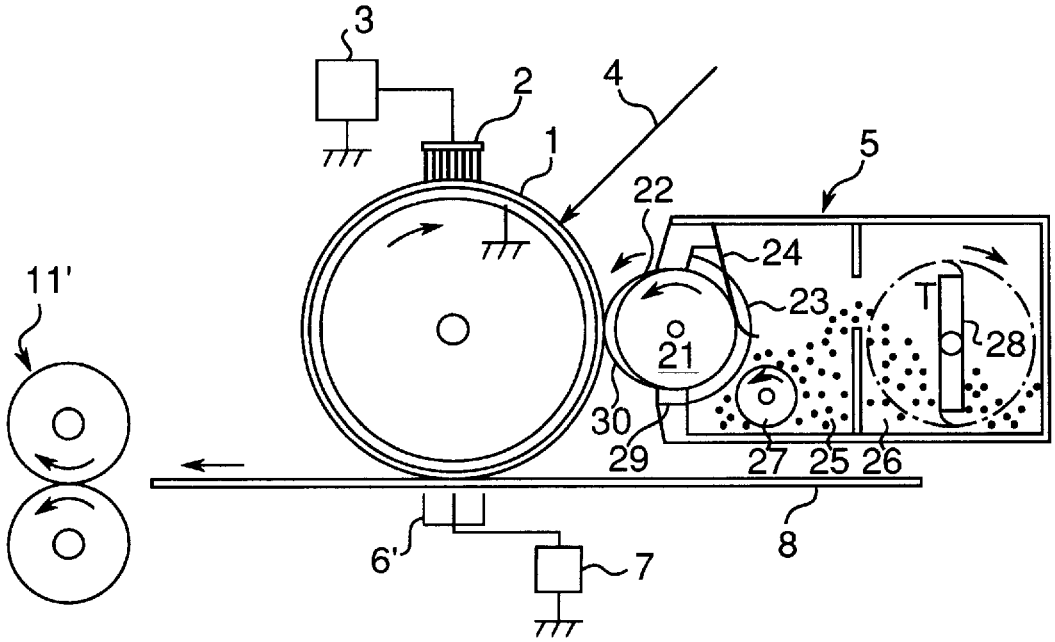
FIG. 2 is a schematic diagram of one-component developing apparatus, not equipped with a cleaning device and a destaticizing device.

The image forming apparatus shown in FIG. 2 does not include such components as cleaning device 9 and destaticizer 10 which the FIG. 1 apparatus includes, whereby some cost reduction is achieved. In the FIG. 2 apparatus, the developing apparatus 5 performs collection of residual toner and development of electrostatic latent images, and the charging brush 2 performs charging and destaticizing of the photosensitive drum 1. The apparatus includes a needle electrode 6' to which a bias of a polarity opposite to the polarity of charged toner is applied by power supply 7, the needle electrode 6' acting as a transfer device. The fixing unit comprises a fixing roller pair 11' (spring pressure of, for example, 6.2 kg) which includes a heating roller having an internally disposed heater (not shown), and pressure roller held in abutment against the heating roller, the diameter (for example, 16 mm) of the heating roller being smaller than the diameter (20 mm) of the pressure roller. According to this arrangement, the fixing nip is somewhat wider so that fixation performance can be improved with respect to a thick medium.

The configuration of a fixing unit with which the toner of the invention can be advantageously used is such that, from the standpoint of size reduction of image forming apparatus, the diameter of the fixing roller pair is not more than 25 mm, preferably from 10 to 20 mm, with spring pressure set to the range of from 3.0 to 8.0 kg.

The following examples are given to further illustrate the invention.

EXAMPLES

(Synthesis of low molecular weight polyester resin I-A)

A 3-liter four-necked flask, fitted with a reflux condenser, a water separator, a $N_2$ gas inlet pipe, a thermometer, and an agitation device, was set in a mantle heater. Introduced into the flask were 590 g of an adduct of bisphenol A with propylene oxide, 110 g of an adduct of bisphenol A with ethylene oxide, 180 g of isophthalic acid, and 35 g of terephthalic acid, and the content was subjected to polycondensation and dehydration at 230° C. while $N_2$ gas being introduced into the flask. Thus, a low molecular weight polyester resin I-A (Tg; 60° C.) was obtained.

(Synthesis of high molecular weight polyester resin I-B)

A 3-liter four-necked flask, fitted with a reflux condenser, a water separator, a $N_2$ gas inlet pipe, a thermometer, and an agitation device, was set in a mantle heater. Introduced into the flask were 810 g of an adduct of bisphenol A with propylene oxide, 50 g of an adduct of bisphenol A with ethylene oxide, 800 g of isophthalic acid, 165 g of 1, 6-dipropyl-1, 6-hexane diol, and 40 g of glycerin, and the content was subjected to polycondensation and dehydration at 250° C. while $N_2$ gas being introduced into the flask. Thus, a high molecular weight polyester resin I-B (Tg; 36° C.) was obtained.

(Synthesis of low molecular weight polyester resin I-C)

A 3-liter four-necked flask, fitted with a reflux condenser, a water separator, a $N_2$ gas inlet pipe, a thermometer, and an agitation device, was set in a mantle heater. Introduced into the flask were 450 g of an adduct of bisphenol A with propylene oxide, 250 g of an adduct of bisphenol A with ethylene oxide, 165 g of isophthalic acid, and 50 g of terephthalic acid, and the content was subjected to polycondensation and dehydration at 240° C. while $N_2$ gas being introduced into the flask. Thus, a low molecular weight polyester resin I-C (Tg; 62° C.) was obtained.

(Synthesis of high molecular weight polyester resin I-D)

A 3-liter four-necked flask, fitted with a reflux condenser, a water separator, a $N_2$ gas inlet pipe, a thermometer, and an agitation device, was set in a mantle heater. Introduced into the flask were 820 g of an adduct of bisphenol A with propylene oxide, 510 g of isophthalic acid, 170 g of 1, 6-dipropyl-1, 6-hexane diol, and 83.5 g of glycerin, and the content was subjected to polycondensation and dehydration at 240° C. while $N_2$ gas being introduced into the flask. Thus, a high molecular weight polyester resin I-D (Tg; 32° C.) was obtained.

Example I-1

First, 65 parts by weight of aforesaid low molecular weight polyester resin I-A and 35 parts by weight of high molecular weight polyester resin I-B were mixed together in Henschel mixer. Then, the mixture was placed in a heated kneader and 1.35 parts by weight of diphenylmethane-4, 4-diisocyanate were charged into the kneader. Reaction was carried out at 125° C. for 1 hour to give an urethane-modified polyester resin (MI value: 4.3 g/10 min. (150° C.); Tm: 124° C.; Tg: 67.1° C.; Av: 33.4 KOHmg/g) was obtained.

| | Wt Parts |
|---|---|
| Urethane modified polyester resin (mentioned above) | 100 |
| Carbon black (Morgal L; Cabot K.K.) | 4 |
| Charge controlling agent (Bontron S-34, made by Orient Kagaku K.K.) | 2 |
| Anti-offset agents | |
| Carnauba wax (Tm: 85° C.; Av: 4; made by Kato Yoko Co.) | 1.5 |
| Biscol TS-200 (Tm: 145° C.; Av: 3.5; made by Sanyo Kasei Co.) | 1.0 |

Above mentioned materials were thoroughly mixed in Henschel mixer. Then, the mixture was kneaded in a twin screw kneading extruder. After being allowed to be cool, the kneaded product was roughly pulverized in a feather mill. The roughly pulverized material was then pulverized finely in a jet mill. The resulting product was air classified to give a toner particles having a volume mean particle size of 8.3 $\mu$m, in which the proportion of fine particles of not more than 5 $\mu$m was 2.9 wt % and the proportion of coarse particles of 20 $\mu$m or more was 0 wt %. Then, 100 parts by weight of the toner particles and 0.5 parts by weight of a fluidizing agent ("Taranox"; made by Talco K.K.) were mixed in Henschel mixer at 2,300 rpm for 90 min. A toner was thus obtained.

Example I-2

A toner was obtained in the same way as in Example I-1, except that 2.5 parts by weight of sazol wax A7 (Tm: 90° C.; Av: 27; made by Kato Yoko Co.), and 1.0 part by weight of Biscol TS-200 (Tm:145° C.; Av: 3.5; made by Sanyo Kasei K.K.) were used as anti-offset agents.

Example I-3

A toner was obtained in the same way as in Example I-1, except that the synthesis of a urethan modified polyester resin was carried out in the following way.

Seventy five parts by weight of aforesaid low molecular weight polyester resin I-A and 25 parts by weight of high molecular weight polyester resin I-B were mixed together in Henschel mixer; then the mixture was placed in a heated kneader and 1.45 parts by weight of hexamethylene isocyanate were charged into the kneader. Reaction was carried out at 120° C. for 1 hour. Thus, a urethane modified polyester resin (MI value: 7.9 g/10 min. (150° C.); Tm: 113° C.; Tg: 62.9° C.; Av: 24.8 KOHmg/g) was obtained.

Example I-4

A toner was obtained in the same way as in Example I-1, except that the synthesis of a urethan modified polyester resin was carried out in the following way.

Eighty five parts by weight of aforesaid low molecular weight polyester resin I-C and 15 parts by weight of high molecular weight polyester resin I-D were mixed together in Henschel mixer; then the mixture was placed in a heated kneader and 1.50 parts by weight of diphenylmethane-4, 4-diisocyanate were charged into the kneader. Reaction was carried out at 125° C. for 1 hour. Then, a urethane modified polyester resin (MI value: 11.3 g/10 min. (150° C.); Tm: 113° C.; Tg: 62.9° C.; Av: 24.8 KOHmg/g) was obtained.

Example I-5

A toner was obtained in the same way as in Example I-1, except that the synthesis of a urethan modified polyester resin was carried out in the following way.

First of all, 70 parts by weight of aforesaid low molecular weight polyester resin I-C and 30 parts by weight of high molecular weight polyester resin I-D were mixed together in Henschel mixer; then the mixture was placed in a heated kneader and 1.27 parts by weight of diphenylmethane-4, 4-diisocyanate were charged into the kneader. Reaction was carried out at 125° C. for 1 hour. Then, a urethane modified polyester resin (MI value: 8.6 g/10 min. (150° C.); Tm: 119° C.; Tg: 63.7° C.; Av: 29.6 KOHmg/g) was obtained.

Example I-6

A toner was obtained in the same way as in Example I-1, except that a polyester resin synthesized in the following way was used.

A 5-liter four-necked flask, equipped with a reflux condenser, a water separator, a $N_2$ gas inlet pipe, a thermometer, and an agitation device, was set in a mantle heater. Introduced into the flask were 450 g of an adduct of bisphenol A with propylene oxide, 300 g of an adduct of bisphenol A with ethylene oxide, 410 g of terephthalic acid, and 38.5 g of trimellitic acid, and the content was subjected to polycondensation and dehydration at 200° C. while $N_2$ gas being introduced into the flask. Then, a polyester resin (MI value: 5.1 g/10 min (150° C.); Tm: 123° C.; Tg; 65.2° C.; Av: 18 KOHmg/g) was obtained.

Comparative Example I-1

A toner was obtained in the same way as in Example I-1, except that the synthesis of a urethan modified polyester resin was carried out in the following way.

First, 50 parts by weight of aforesaid low molecular weight polyester resin I-A and 50 parts by weight of high molecular weight polyester resin I-B were mixed together in Henschel mixer; then the mixture was placed in a heated kneader and 1.72 parts by weight of diphenylmethane-4, 4-diisocyanate were charged into the kneader. Reaction was carried out at 125° C. for 1 hour. Then, a urethane modified polyester resin (MI value: 2.3 g/10 min. (150° C.); Tm: 143° C.; Tg: 72.5° C.; Av: 20.1 KOHmg/g) was obtained.

Comparative Example I-2

A toner was obtained in the same way as in Example I-1, except that the synthesis of a urethan modified polyester resin was carried out in the following way.

First, 90 parts by weight of aforesaid low molecular weight polyester resin I-A and 10 parts by weight of high molecular weight polyester resin I-B were mixed together in Henschel mixer; then the mixture was placed in a heated kneader and 1.18 parts by weight of diphenylmethane-4, 4-diisocyanate were charged into the kneader. Reaction was carried out at 125° C. for 1 hour. Then, a urethane modified polyester resin (MI value: 14.8 g/10 min. (150° C.); Tm: 111° C.; Tg: 60.9° C.; Av: 20.1 KOHmg/g) was obtained.

Comparative Example I-3

A toner was obtained in the same way as in Comparative Example I-2, except that 1.0 part by weight of Biscol TS-200 (Tm: 145° C.; Av: 35; made by Sanyo Kasei K.K.) was used as anti-offset agent.

Example I-7

A toner was obtained in the same way as in Example I-1, except that 3.0 parts by weight of carnauba wax (Tm: 85° C.; Av: 4; made by Kato Yoko K.K.) was used as anti-offset agent.

Example I-8

A toner was obtained in the same way as in Example I-1, except that 3.0 parts by weight of carnauba wax (Tm: 85° C.; Av: 4; made by Kato Yoko K.K.), and 1.0 part by weight of Biscol 550P (Tm:145° C.; Av: 0; made by Sanyo Kasei K.K.) were used as anti-offset agents.

(Evaluation Method)

By using an electrophotographic printer (SP-1000, with system speed of 35 mm/s; made by Minolta K.K.) modified so as to enable adjustment of temperature setting for the fixing roller within the range of from 80° to 240° C., evaluation of each type of toner obtained was carried out with respect to non-offset region and fixing strength in a manner as described hereinbelow. The results are shown, together with MI values of binder resin and toner, in Table 1. The measurements of non-offset region, fixing strength and MI value were made in the following manner.

Non-offset zone

Roller temperature setting was varied from 80° C. to 240° C. at 5° C. intervals so as to help finding a temperature range within which there was no offset occurrence. The higher side temperature within a non-offset range is preferably at least 30° C. higher than a fixation temperature.

Fixing strength

Figure 3:
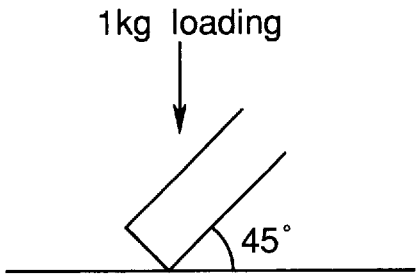
FIG. 3 is a view explanatory of the method for fixing-strength measurement.

Toner images were fixed at roller temperature of 120° C. and 150° C. respectively, and each image was contacted by a sand eraser capable of applying a 1 kg load which was attached to a pencil hardness tester modified as shown in FIG. 3. The eraser was reciprocated three times over the image. Thereafter, image density (ID) measurement was made and fixing strength was determined according to the following equation. A fixing strength of 85% or more is required. With respect to Comparative Examples 1 and 3, fixing strength at preset roller temperature of 120° C. could not be measured due to offset occurrence. Likewise, with respect to Example 7, fixing strength at preset roller temperature of 150° C. could not be measured due to offset occurrence.

$$\text{Fixing strengh} = \frac{ID \text{ after rubbing}}{ID \text{ prior to rubbing}} \times 100\%$$

MI value

MI values of binder resin and toner were measured in accordance with JIS (Japanese Industrial Standards) K-7210, Method A. Temperatures at which measurement was made were 150° C. for binder resin, and 125° C. for toner. In both cases, a load of 2.169 kg was applied.

Measurement results are shown in Table 1 below.

TABLE 1

| | Resin MI value (g/10 min) at 150° C. | Toner MI value (g/10 min) at 125° C. | Non-offset range | Fixing strength 120° C. | Fixing strength 150° C. |
|---|---|---|---|---|---|
| Ex. I-1 | 4.3 | 21.4 | 110–240° C. | 88% | 100% |
| Ex. I-2 | 4.3 | 21.9 | 110–240° C. | 85% | 100% |
| Ex. I-3 | 7.9 | 26.3 | 105–230° C. | 92% | 100% |
| Ex. I-4 | 11.3 | 38.4 | 100–210° C. | 98% | 100% |
| Ex. I-5 | 8.6 | 31.4 | 95–220° C. | 95% | 100% |
| Ex. I-6 | 5.1 | 24.6 | 110–230° C. | 90% | 100% |
| Ex. I-7 | 4.3 | 25.8 | 105–150° C. | 100% | — |
| Ex. I-8 | 4.3 | 24.9 | 110–240° C. | 86% | 100% |
| Comp. Ex. I-1 | 2.3 | 12.7 | 145–240° C. | — | 87% |
| Comp. Ex. I-2 | 14.8 | 42.3 | 90–160° C. | 100% | 100% |
| Comp. Ex. I-3 | 14.8 | 37.1 | 145–240° C. | — | 55% |

These types of toners were applied for use with the above mentioned printer, and durability test with respect to printing was carried out for 8,000 sheets each. At each end of 2,000th sheet printing, 5,000th sheet printing, and 8,000th sheet printing, evaluation was made with respect to image density, fogging, filming and adhesion in manner as described blow. Evaluation results are shown in Table 2. With respect to Comparative Examples I-1 and I-3, durability test with respect to printing could not be made due to offset occurrences.

Image density

At the end of each respective durability test with respect to printing, measurement of image density was carried out by means of a "Sakura" densitometer (made by Konica K.K.). A density of 1.4 or more was classified as 0, a density of less than 1.4 was ranked as Δ, and a density of less than 1.2 was ranked as x.

Fogging

At the end of each respective durability test with respect to printing, fogging on the image was visually checked. Those without fog were ranked as A, those with fogging but which involve practically no problem were ranked as Δ, and those with fogs which were considered practically unfavorable were ranked as x.

Adhesion

At the end of respective durability test, the surface of the developing sleeve was visually checked. Toner adhesion to the toner regulating blade led to white streak formation on the sleeve. Those which led to white streak formation were ranked as x; those involving no white streak were ranked as 0; and those with which a slight degree of streak occurred but which involved practically no problem were classified as Δ.

The measurement results are shown in Table 2.

TABLE 2

| | Print withstand test | | | | | | | | | | | |
|---|---|---|---|---|---|---|---|---|---|---|---|---|
| | 2000 sheets | | | | 5000 sheets | | | | 8000 sheets | | | |
| | Image density | Fog | Filming | Adhesion resistance | Image density | Fog | Filming | Adhesion resistance | Image density | Fog | Filming | Adhesion resistance |
| E I-1 | ○ | ○ | ○ | ○ | ○ | ○ | ○ | ○ | ○ | ○ | ○ | ○ |
| E I-2 | ○ | ○ | ○ | ○ | ○ | ○ | ○ | ○ | ○ | ○ | ○ | ○ |
| E I-3 | ○ | ○ | ○ | ○ | ○ | ○ | ○ | ○ | ○ | ○ | ○ | ○ |
| E I-4 | ○ | ○ | ○ | ○ | ○ | ○ | ○ | ○ | ○ | ○ | ○ | ○ |
| E I-5 | ○ | ○ | ○ | ○ | ○ | ○ | ○ | ○ | ○ | ○ | ○ | ○ |
| E I-6 | ○ | ○ | ○ | ○ | ○ | ○ | ○ | ○ | ○ | ○ | ○ | ○ |
| E I-7 | ○ | ○ | ○ | ○ | ○ | ○ | ○ | ○ | ○ | ○ | ○ | ○ |
| E I-8 | ○ | ○ | ○ | ○ | ○ | Δ | Δ | ○ | ○ | x | x | Δ |
| Comp. E I-1 | — | — | — | — | — | — | — | — | — | — | — | — |
| Comp. E I-2 | ○ | ○ | ○ | ○ | ○ | x | Δ | Δ | Δ | x | x | x |
| Comp. E I-3 | — | — | — | — | — | — | — | — | — | — | — | — |

E: Example, Comp. E: Comparative Example

Toners obtained in Comparative Examples I-1 and I-3, wherein the lower limit of the non-offset range was high, suffered from offset occurrence at the fixation temperature of 120° C., and therefore fixing strength measurement could not be made with respect these toners. Therefore, the toners are unsuitable for low temperature fixing. The toner of Comparative Example I-1 showed poor productivity since the MI value of the component resin was low.

The toner obtained in Comparative Example I-2 had a problem with respect to image quality after printing of 5000 sheets. Presumably, since the MI value of the component resin was high, there occurred fine powder generation, which led to the image quality problem. In Comparative Example I-2, the MI value of the toner was high and, therefore, the upper limit of the non-offset range was low.

In the toner obtained in Example I-7, the non-offset range was narrow. because any anti-offset agent having a high softening point was not used.

The toner obtained in Example I-8 involved a filming problem after printing of 5000 sheets, since an anti-offset agent having a high softening point but having no acid value was used.

The toner of the present invention is a toner for developing electrostatic images which has good adhesion resistance and good low temperature fixing property, and further can exhibit good image developing performance in various quality aspects including fog resistance, filming resistance, and image density.

(Synthesis of polyester resin II-A)

A 5-liter four-necked flask, fitted with a reflux condenser, a water separator, a $N_2$ gas inlet pipe, a thermometer, and an agitation device, was set in a mantle heater. Introduced into the flask were 1,376 g of an adduct of bisphenol A with propylene oxide, 398 g of isophthalic acid, 113 g of succinic acid and 85 g of diethylene glycol, and the content was subjected to polycondensation and dehydration at temperature between 220° and 270° C. while $N_2$ gas being introduced into the flask. Thus, a polyester resin II-A (Tg; 60° C.) was obtained. The polyester resin had the following physical properties: glass transition point (Tg): 60° C., softening point (Tm): 100° C., number average molecular weight (Mn):5,000, weight average molecular weight (Mw):12,000, aid value (Av):23 KOHmg/g.

(Synthesis of polyester resin II-B

A 5-liter four-necked flask, fitted with a reflux condenser, a water separator, a $N_2$ gas inlet pipe, a thermometer, and an agitation device, was set in a mantle heater. Introduced into the flask were 1,200 g of an adduct of bisphenol with propylene oxide, 110 g of neopentyl glycol and 850 g of isophthalic acid, and the content was subjected to polycondensation and dehydration at temperature between 220° and 270° C. while $N_2$ gas being introduced into the flask. Thus, a low molecular weight polyester resin was obtained.

Then, a 5-liter four-necked flask, fitted with a reflux condenser, a water separator, a $N_2$ gas inlet pipe, a thermometer, and an agitation device, was set in a mantle heater. Introduced into the flask were 1,720 g of an adduct of bisphenol with propylene oxide, 860 g of isophthalic acid, 119 g of succinic acid, 129 g of diethylene glycol, and 74.6 g of glycerin, and the content was subjected to polycondensation and dehydration at temperature of 240° C. while $N_2$ gas being introduced into the flask. Thus, a high molecular weight polyester resin was obtained.

The low molecular weight polyester resin (4,200 parts by weight) and 2,800 parts by weight of high molecular weight polyester resin were mixed together in Henschel mixer until the mixture was uniform. Then, the mixture was placed in a heated kneader and 100 parts by weight of diphenylmethane-4, 4-diisocyanate were charged into the kneader. Reaction was carried out at 120° C. for 1 hour. After it was confirmed that almost no residual free isocyanate group appeared by NCO % measurement, polyester resin II-B having urethane bonds was obtained after cooling. Physical properties of the polyester II-B were as follows; Tg:65° C., Tm:140° C., Av:25 KOHmg/g, content of components insoluble in methyl ethyl ketone:20 percent by weight).

Preparation of Toner
Example II-1

| | Wt Parts |
|---|---|
| Polyester resin II-A | 50 |
| Polyester resin II-B | 50 |
| Carbon black (Morgal L; Cabot K.K.) | 5 |
| Charge controlling agent (Bontron S-34, made by Orient Kagaku K.K.) | 2 |
| Oxidized-type low molecular weight polypropylene (Tm: 145° C., Av: 3.5 KOH mg/g) (Biscol TS-200, made by Sanyo Kasei K.K.) | 2 |
| Carnauba wax (Tm: 85° C.; Av: 4 KOH mg/g, made by Kato Yoko K.K.) | 2 |

Above mentioned materials were thoroughly mixed in Henschel mixer. Then, the mixture was kneaded in a twin screw kneading extruder. After being allowed to be cool, the kneaded product was roughly pulverized in a feather mill. The roughly pulverized material was then pulverized finely in a jet mill. The resulting product was air classified to give a toner particles having a volume mean particle size of 8 $\mu$m. Then, 100 parts by weight of the toner particles and 0.8 parts by weight of hydrophobic silica ("Taranox"; made by Talco K.K.) were mixed in Henschel mixer. A toner the surface of which was treated with hydrophobic silica was thus obtained.

Example II-2

Toner was prepared in a manner similar to Example II-1, except that 10 parts by weight of polyester II-A and 90 parts by weight of polyester II-B were used.

Example II-3

Toner was prepared in a manner similar to Example II-1, except that 20 parts by weight of polyester II-A and 80 parts by weight of polyester II-B were used.

Example II-4

Toner was prepared in a manner similar to Example II-1, except that 30 parts by weight of polyester II-A and 70 parts by weight of polyester II-B were used.

Comparative Example II-1

Toner was prepared in a manner similar to Example II-1, except that 100 parts by weight of polyester resin II-B was used instead of 50 parts by weight of polyester II-A and 50 parts by weight of polyester II-B.

Comparative Example II-2

Toner was prepared in a manner similar to Example II-1, except that 80 parts by weight of polyester resin II-A and 20 parts by weight of polyester resin II-B were used instead of 50 parts by weight of polyester II-A and 50 parts by weight of polyester II-B.

Comparative Example II-3

Toner was prepared in a manner similar to Example II-2, except that carnauba wax was not added.

(Evaluation Method)

By using an electrophotographic printer (SP-1,000, with system speed of 35 mm/s; made by Minolta K.K.) modified so as to enable adjustment of temperature setting for the fixing roller and not to have a cleaning device as shown in FIG. 2, evaluation of each type of toner obtained was carried out with respect to adhesion properties, fixing strength, fogging on the photosensitive member, heat resistance, offset region, MI value and grindability index.

Adhesion properties

Each toner was placed in the developing device of the electrophotographic printer SP-1,000 without photosensitive member) and the sleeve was rotated for 30 successive hours. When toner adhesion occurs on the blade, white lines appear on the sleeve. When the white lines appeared, it was ranked as "x". When a little white lines appeared, it was ranked as "Δ". When no white lines appeared, it was ranked "x".

Fixing Strength

Fixing strength was measured in the same manner as described above, except that toner images were fixed at roller temperature of 140° C. A fixing strength of 85% or more is required. When the fixing strength is 85% or more, it was ranked as "o". When the fixing strength is less than 85%, it was ranked as "x".

Fogging on photosensitive member

Toner images were fixed with temperature of the roller adjusted at 130° C. to observe fogging on the photosensitive member at initial stage and after 3,000 times of copy. When almost no fog was observed, it was ranked as "⊙". When a few fogs were observed, but there was no practical problem, it was ranked as "o". When fogs were observed, it was ranked as "Δ". When many fogs were observed, it was ranked as "x".

Heat resistance

Five grams of toner was placed in a glass bottle, which was left to stand in environmental atmosphere of 60° C. for 5 hours. When toner aggregated, it was ranked as "x". When toner aggregation was not observed, it was ranked as to "o".

Non-offset zone

Roller temperature setting was varied from 110° C. to 220° C. at 5° C. intervals so as to help finding a temperature range within which there was no offset occurrence. It is necessary for the off-set range to have 140° C.±20° C.

MI value was measured as described above.

Grindability index

Cripton grinder (KTM-I type, made by Kawasaki Ju-kogyo K.K.) was set to closed system and a loading power ($W_0$(W)) of the motor for pulverizing roller was recorded when the revolution number of the motor was set at 9,300 rpm and total air flow at 7.0 $Nm^3$.

Then, the roughly pulverized particles (average particle size:$D_0$) pulverized by feather mill was threw into the grinder through a feeder at a constant amount (F) of 40 kg/hr. The increased loading power ($W_1$(W)) was recorded. An average particle size ($D_1$) was measured by Coulter counter (made by Nikkaki K.K.) after pulverization. The grindability index (K) was calculated according to the following equation:

$$K = \frac{W_1 - W_0}{F} \times \frac{D_0 D_1}{D_0 - D_1}$$

K: Grindability index (W·hr·mm·/kg)

$D_0$: Particle size before pulverization (μm)

$1_0$: Particle size after pulverization (μm)

$W_1$: Loading power (W) at pulverization $W_0$: Loading power (W) without feeding F: Feeding amount (kg/hr)

But, in the case of $D_0 >> D_1$, the grindability index was calculated according to the following equation:

$$K = \frac{W_1 - W_0}{F} \times D_1$$

The results were shown in Table 3.

TABLE 3

| | Ex. II-1 | Ex. II-2 | Ex. II-3 | Ex. II-4 | Comp. Ex. II-1 | Comp. Ex. II-2 | Comp. Ex. II-3 |
|---|---|---|---|---|---|---|---|
| MI value | 38.8 | 16.7 | 20.1 | 34.5 | 7.3 | 40.1 | 9.8 |
| grindability index | 1.1 | 2.8 | 2.4 | 1.5 | 3.6 | 0.8 | 2.6 |
| adhesion resistance | Δ | o | o | o | o | Δ | o |
| fixing strength | o | o | o | o | — | o | — |
| fogging on PSM* | Δ | o | o | o | ⊙ | x | Δ |
| heat resistance | o | o | o | o | o | o | o |
| non offset region | 115–200° C. | 125–24° C. | 125–23° C. | 120–22° C. | 155–24° C. | 110–15° C. | 140–24° C. |

*PSM: photosensitive member, Ex.: Example, Comp. Ex.: Comparative Example

The toner of Comparative Example II-3 had a problem with respect to low temperature fixation. As this toner had a low MI value, it is thought that the viscosity of the toner was high at fixation, resulting in low flowability. Further, as offset generation is high, fixing strength could not be measured.

The toner of comparative Example II-2 caused high generation of fogs on the photosensitive member. Adhesion resistance was not excellent. As this toner had a low grindability index, it is thought that the toner is soft and fragile, resulting in high generation of fine particles when electrically charged. The cleaning properties for the photosensitive member might be poor.

As the toner of Comparative Example II-3 showed high generation of offset at low temperature fixation, the fixing strength could not be measured.

The toner of the present invention is one-component toner excellent in adhesion resistance, low temperature fixation and cleaning properties for electrostatic latent image-keeping member as well as heat resistance. The toner of the present invention has a good offset region.

What is claimed is:

1. A toner fixed by heat, comprising a binder resin having a melt index value of 3 to 12 (g/10 minutes) at 150° C., a colorant and an offset-preventing agents, the toner having a melt index value of 15 to 40 (g/10 minutes) at 125° C.

2. The toner of claim 1, wherein the binder resin has a softening point of 90° to 135° C. and a glass transition point of 55° to 75° C.

3. The toner of claim 2, wherein the binder resin has a softening point of 95° to 130° C., a glass transition point of 57° to 68° C. and an acid value of 5 to 50 KOHmg/g.

4. The toner of claim 2, wherein the binder resin comprises polyester resin or modified polyester resin.

5. The toner of claim 2, wherein the offset-preventing agent has a softening point of 60° to 150° C. and is contained at an amount of 2 to 7 parts by weight on the basis of 100 parts by weight of the binder resin.

6. The toner of claim 5, wherein the offset-preventing agent has an acid value of 1 to 45 KOHmg/g.

7. The toner of claim 5, wherein the offset-preventing agent comprises a first offset-preventing agent having a softening point lower than that of the binder resin and being within the range between 60° and 100° C. and a second offset-preventing agent having a softening point higher than that of the binder resin and being within the range between 110° and 150° C.

8. The toner of claim 7, wherein the first offset-preventing agent has a softening point of 10° C. or more lower than that of the binder resin and the second offset-preventing agent has a softening point 10° C. or more higher than that of the binder resin.

9. The toner of claim 7, wherein the first offset-preventing agent is contained at an amount of 1 to 6 parts by weight on the basis of 100 parts by weight of the binder resin, the second offset-preventing agent is contained at an amount of 0.5 to 5 parts by weight on the basis of 100 parts by weight of the binder resin, and the total amount of the first and second offset-preventing agents is 2 to 7 parts by weight on the basis of 100 parts by weight of the binder resin.

10. The toner of claim 7, wherein the first offset-preventing agent has an acid value of 1 to 20 KOHmg/g and the second offset-preventing agent has an acid value of 1 to 30 KOHmg/g.

11. The toner of claim 1, further comprising a fluidizing agent the surface of which is treated by a hydrophobic agent selected from the group consisting of a silane coupling agent, a titanium coupling agent, a higher fatty acid, a silicone oil and a mixture thereof, being contained at an amount of 0.05 to 5 parts by weight on the basis of 100 parts by weight.

12. The toner of claim 1, being a nonmagnetic one-component toner suitable for a one-component developing apparatus equipped with a developing roller and a developer-regulating member pressed against the developing roller.

13. The toner of claim 12, wherein the developing apparatus can collect a residual toner on the electrostatic latent-image keeping member without a cleaning device.

14. A one-component developing toner fixed by heat, comprising a binder resin, a colorant and an offset-preventing agent, the toner having a melt index value of 10 to 40 (g/10 minutes) at 125° C., a grindability index of 1 to 3 and a volume mean particle size of 5 to 9 $\mu$m.

15. The toner of claim 14, wherein the melt index value is 15 to 40, the grindability index is 1.5 to 3 and the volume mean particle size is 6 to 8 $\mu$m.

16. The toner of claim 14, being a nonmagnetic one-component toner suitable for a one-component developing apparatus equipped with a developing roller and a developer-regulating member pressed against the developing roller.

17. The toner of claim 16, wherein the developing apparatus can collect a residual toner on the electrostatic latent-image keeping member without a cleaning device.

18. A method for forming copy images, comprising;

forming electrostatic latent images on a electrostatic latent image-keeping member, developing the electrostatic latent images by a non-magnetic one-component toner accommodated in a one-component developing apparatus equipped with a developing roller and a developer-regulating member pressed against the developing roller, transferring the developed toner to a transfer medium, and fixing by heat the toner transferred on the transfer medium, the toner comprising a binder resin having a melt index value of 3 to 12 (g/10 minutes) at 150° C., a colorant and an offset-preventing agent and having a melt index value of 15 to 40 (g/10 minutes) at 125° C.

19. The method of claim 18, wherein the binder resin has a softening point of 90° to 135° C. and a glass transition point of 55° to 75° C.

20. The method of claim 18, wherein the offset-preventing agent has a softening point of 60° to 150° C. and is contained at an amount of 2 to 7 parts by weight on the basis of 100 parts by weight of the binder resin.

* * * * *